United States Patent [19]

Martin et al.

[11] Patent Number: 5,012,072

[45] Date of Patent: Apr. 30, 1991

[54] CONFORMABLE FUSING SYSTEM

[75] Inventors: Robert G. Martin, Irondequoit; Alan M. Litman, Webster, both of N.Y.

[73] Assignee: Xerox Corporation, Stamford, Conn.

[21] Appl. No.: 522,934

[22] Filed: May 14, 1990

[51] Int. Cl.[5] ..... G03G 15/20

[52] U.S. Cl. ..... 219/469; 219/216; 355/290

[58] Field of Search ..... 219/269, 270, 271, 216; 355/290; 432/60, 228

[56] References Cited

U.S. PATENT DOCUMENTS

| | | | |
|---|---|---|---|
| 3,449,548 | 6/1969 | Adamek | 219/216 |
| 3,666,247 | 5/1972 | Banks | 432/60 |
| 4,001,544 | 4/1977 | Heinzer | 219/216 |
| 4,219,327 | 8/1980 | Idstein | 432/60 |
| 4,290,691 | 9/1981 | Giorgini | 355/3 |
| 4,420,680 | 12/1983 | Itoh | 219/216 |
| 4,501,482 | 2/1985 | Stryjewski | 355/3 |
| 4,567,349 | 1/1986 | Henry et al. | 219/216 |
| 4,627,813 | 12/1986 | Sasaki | 432/60 |
| 4,814,819 | 3/1989 | Torino | 219/469 |
| 4,883,941 | 11/1989 | Martin et al. | 219/216 |

FOREIGN PATENT DOCUMENTS 59-172668 9/1984 Japan .

*Primary Examiner*—Teresa J. Walberg
*Attorney, Agent, or Firm*—Ronald F. Chapuran

[57] ABSTRACT

A fusing apparatus including a heater roll disposed transverse the direction of movement of the support material, the heater roll being stiff in the longitudinal direction and conforming in the hoop direction, a core supporting the heater roll, the heater roll being disposed about the circumference of the core, the core being conforming in the hoop direction, and a back up role disposed transverse the direction of movement of the support material, the back up role being stiff in the longitudinal direction and conforming in the hoop direction, the engagement of the heater role and the back up role defining an elongated, essentially flat nip.

12 Claims, No Drawings

CONFORMABLE FUSING SYSTEM

BACKGROUND OF THE INVENTION

This invention relates to an improved fuser apparatus and more particularly to a conformable roll fusing system.

In order to fuse electroscopic toner material permanently onto a support surface by heat, it is usually necessary to elevate the temperature of the toner material to a point at which the constituents of the toner materials coalesce and become tacky. This heating causes the toner to flow to some extent into the fibers or pores of the support member. Thereafter, as the toner material cools, solidification of the toner material causes the toner material to become firmly bonded to the support member.

PRIOR ART

The use of the thermal energy for fixing toner images onto a support member is well known. Several approaches to thermal fusing of electroscopic toner images have been described in the prior art. These methods include providing the application of heat and pressure substantially concurrently by various means. for example, a roll pair maintained in pressure contact, a flat or curved plate member in pressure contact with a roll, and a belt member in pressure contact with a roll.

Prior art fusing systems have been effective in providing the fusing of many copies in relatively large fast duplicating machines, in which the use of standby heating elements to maintain the machine at or near its operating temperature can be justified. However, there is a continuing need for fusers which require minimal standby power for maintaining the fuser apparatus at a temperature above the ambient, and in general, require minimal power for opertion. Various prior art techniques are directed to nip size and lower power. For example, Japanese Patent No. 59-172668 to Mihara discloses a pressure roller with a layer of fluororesin which is deformable to make a relatively large nip length upon contacting the heat roller. This extends the time of contacting with toner, therefore, better fixing performance is obtained.

U.S. Pat. No. 4,627,813 to Sasaki discloses a thermal fixing apparatus to be used in copying machines comprising two fixing rolls, one of which is heated, and the other one covered with an elastically deformable layer in order to provide a predetermined nip length upon pressing by the first roll.

U.S. Pat. No. 4,501,482 to Stryjewski discloses a member of compliant material useful as a fuser roller in electrographic copiers or the like. This member includes an elastomeric material and other materials which are solid at ambient temperatures but become fluid at elevated temperatures, therefore becoming deformable. The material used may be of metallic alloys or non-metallic material such as thermoplastics, (column 3, line 56).

U.S. Pat. No. 4,567,349 to Henry et al., assigned to Xerox Corporation, discloses a heat and pressure fuser apparatus including solid adhesive material, such as fluorinated polymers and copolymers (column 2, line 37), as an outer layer of the fuser member. This layer contributes to the formation of the nip between the fuser and the backup roller.

U.S. Pat. No. 4,290,691 to Giorgini discloses a method and apparatus using low gloss pressure fusing roll including a layer of a compliant material, such as nylon, on a first pressure member, and a concomplaint surface on a second pressure member for contacting the non-imaged surface of the receptor.

A difficulty with the prior art fusing systems, however, is that they are often relatively complex and expensive to construct and/or the mass of the system is relatively large to preclude a minimal power fusing capability and at the same time provide sufficient mechanical strength and heating characteristics for multipass color machines. Another difficulty is that prior art fuser rolls even with deformable layers are generally limited in conformability because of the underlying rigid core support.

A critical parameter in roll type Xerographic Fixing Systems is the nip length, i.e., the length of contact between the heating fixing roll and the backup or support roll. This length is usually associated with time and is referred to as Dwell Time, that indirectly affects all other parameters of operating temperature, warm-up, roll speed and final copy fix. The diameter of commercial, rigid fix rolls, and the thickness of these P.F.A., Silicone Rubber or L.I.M. coatings limit the nip length to a range of 60–300 mils. This window is adequate for single pass toner development, but only marginal for multipass color programs or those with limited power requirements.

It is an object of the present invention, therefore, to provide a new and improved conformable fuser apparatus that would provide increased nip lengths to satisfy fusing requirements as well as reduce power consumption. It is another object of the present invention to provide a low mass heater structure capable of repeated flexing in a heated dynamic mode.

Further objects and advantages of the present invention will become apparent as the following description proceeds and the features of novelty characterizing the invention will be pointed out with particularity in the claims annexed to and forming a part of this specification.

SUMMARY OF THE INVENTION

The present invention is concerned with a fusing apparatus comprising a heater roll disposed transverse the direction of movement of the support material, the heater roll being stiff in the longitudinal direction and conforming in the hoop direction, a core supporting the heater roll, the heater roll being disposed about the circumference of the core, the core being conforming in the hoop direction, and a back up roll disposed transverse the direction of movement of the support material, the back up roll being stiff in the longitudinal direction and conforming in the hoop direction, the engagement of the heater roll and the back up role defining an elongated, essentially flat nip.

BRIEF DESCRIPTION OF THE DRAWINGS

For a better understanding of the present invention, reference may be had to the accompanying drawings, wherein a the same reference numerals have been applied to like parts and wherein.

DESCRIPTION OF THE INVENTION

Figure 1:
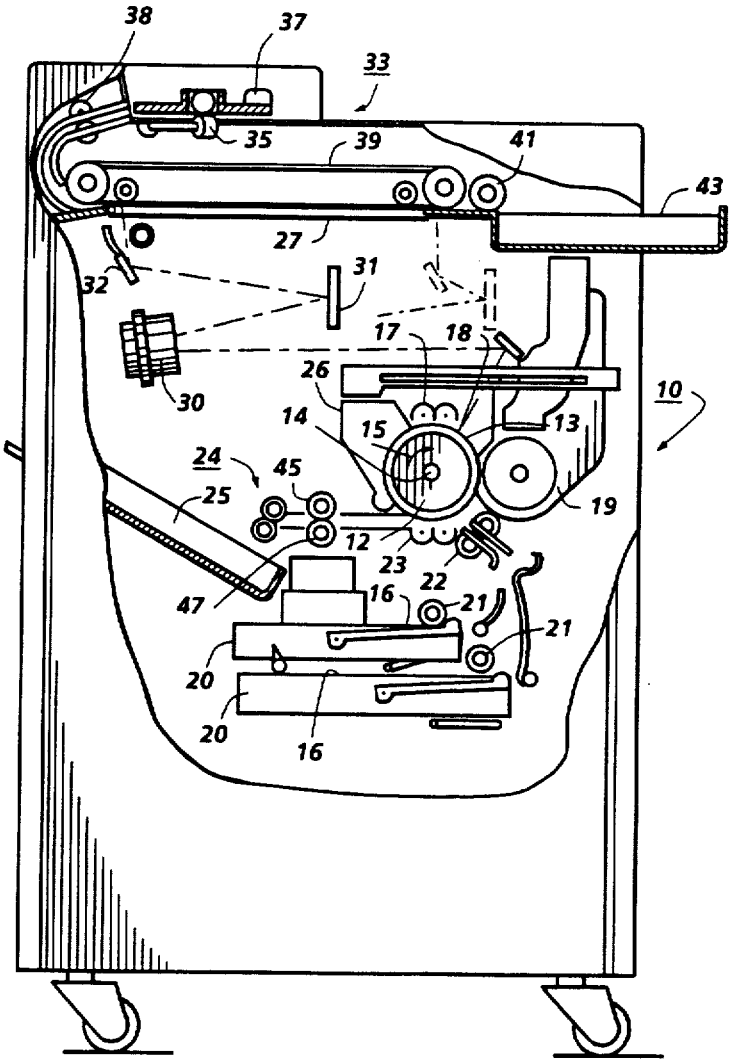
FIG. 1 is an illustration of a reproduction machine incorporating the present invention.

Referring now to FIG. 1, there is shown by way of example an automatic xerogaphic reproducing machine 10 including an image recording drum like member 12, its outer periphery coated with suitable photoconductive material or surface 1. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input information is recorded upon a sheet of final support material or copy sheet 16.

Initially, the drum 12; moves the photoconductive surface 13 through a charging station 17 providing an electrostatic charge uniformly over the photoconductive surface 13 in known manner preparatory to imaging. Thereafter, the drum 12 is rotated to exposure station 18 and charged photoconductive surface 13 is exposed to a light image of the original document to be reproduced. The charge is selectively dissipated in the light exposed regions to record the original document in the form of an electrostatic latent image. After exposure drum 12 rotates the ectrostatic latent image recorded on photoconductive 13 to development station 19 wherein a conventional developer mix is applied to the photoconductive surface 13 of the drum 12 rendering the latent image visible. Typically, a suitable development station could include a magnetic brush development system utilizing a magnetizable developer mix having coarse ferromagnetic carrier granules and toner colorant particles.

The copy sheets 16 of the final support material are supported in a stack arrangement on an elevating stack support tray 20. With the stack at its elevated position a sheet separator 21 feeds individual sheets therefrom to the registration system 22. The sheet is then forwarded to the transfer station 23 in proper registration with the image on the drum. The developed image on the photoconductive surface 13 is brought into contact with the sheet 16 of final support material within the transfer station 23 and the toner image is transferred from the photoconductive surface 13 to the contacting side of the final support sheet 16.

After the toner image has been transferred to the sheet of final support material or copy sheet 16, with the image is advanced to fusing station 24 for coalescing the transferred powder image to the support material. After the fusing process, the copy sheet 16 is advanced to a suitable output device such as tray 25.

Although a preponderance of toner powder is transferred to the copy sheet 16, invariably some residual atoner remains on the photoconductive surface 13. The residual toner particles remaining on the photoconductive surface 13 after the transfer operation are removed from the drum 12 as it moves through a cleaning station 26. The toner particles may be mechanically cleaned from the photoconductive surface 13 by any convenience means, as for example, by the use of a cleaning blade.

Normally, when the copier is operated in a conventional mode, the original document to be reproduced is placed image side down upon a horizontal transparent platen 27 and the stationary original then scanned by means of a moving optical system. The scanning system includes a stationary lens 30 and a pair of cooperating movable scanning mirrors, half rate mirror 31 and full rate mirror 32 supported upon suitable carriages.

A document handler 33 can also be provided including registration assist roll 35 and switch 37. When a document is inserted, switch 37 activates registration assist roll 35 and the document is fed forward and aligned against a rear edge guide for the document handler 33. The pinch rolls 38 are activated to feed a document around 180° curved guides onto the platen 27 for copying. The document is driven by a platen belt transport including platen belt 39. After copying, the platen belt 39 is activated and the document is driven off the platen by the output pinch roll 41 into the document catch tray 43.

The fusing station 24 includes a heated fuser roll 45 and a backup or pressure roll 47 forming a nip through which the copy sheets to be fused are advanced. The pressure roll 47 comprises a rotating member suitably journaled for rotation about a shaft and covered with an elastomeric layer of silicone rubber PFA or any other suitable material. The fuser roll 45 comprises a rotating cylindrical member 48 mounted on a pair of end caps 49 as seen in FIGS. 2 and 3.

Figure 2:
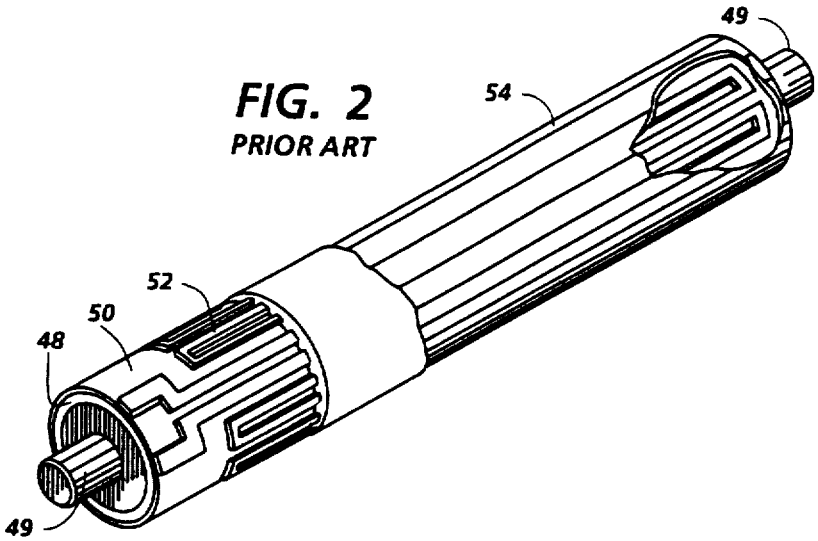
FIG. 2 PRIOR ART
FIG. 2 illustrates a prior art fusing element.
Figure 3:
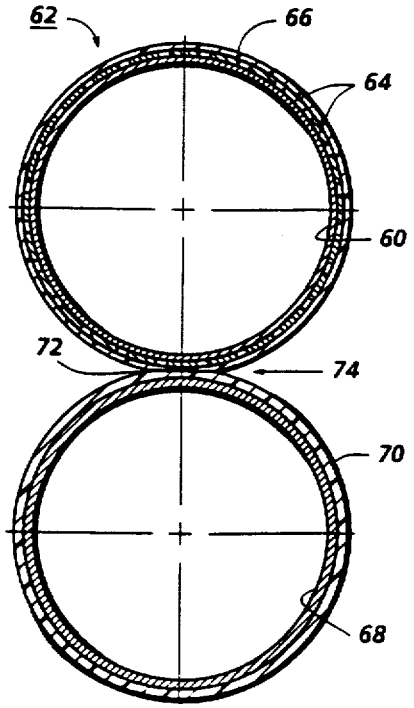
FIG. 3 is an elevational view of the heating roll of the fuser apparatus incorporated in FIG. 1 in accordance with the present invention.

With reference to prior art, FIG. 2, supported on the filament wound cylindrical member 48, is an poly adhesive securing fiber glass backing 50. Supported on the fiber glass backing 50 is suitable heating wire, printed circuit or photo etched circuit pattern 52. A suitable release agent 54 such as PFA or rubber covers the heating element. It is important for the fuser roll to have sufficient mechanical strength including hoop strength and beam strength. The hoop strength is the property of the fuser roll core material to resist inward radial pressure and beam strength is the property of the fuser roll core material to resist bending. It is also known in the prior art to use a filament wound tube or cylinder with the fibers wound at approximately 50 degrees or any other suitable orientation with respect to the longitudinal axis to provide sufficient mechanical strength. However, such filament wound cylinders still require a separate backing and heating element.

It should be noted that it is possible to weave fiber glass, carbon graphite, boron carbide, or any other fiber at a suitable angle to achieve sufficient mechanical strength. In general, the larger the diameter of the cylindrical member 48, the larger a nip that can be formed and the slower the rotational speed. This allows a greater dwell time of the copy sheet in the nip of the fuser formed by the fuser roll 45 and pressure roll 47, dwell time being a function of surface speed plus the size or area of the nip. Higher diameter also means there is more recovery time, that is, the heat is held longer on the outside surface of the fuser roll and there is more time allowed for reheating. A difficulty, however, is usually the need for sufficient mechanical strength. Therefore, using a suitable choice of fibers in the filament wound cylinder plus appropriate angle of fiber weave and suitable epoxy, cylindrical diameters of 3 or 4" are easily obtainable. Wall thicknesses are preferably less than 0.050 inches. In one embodiment, with a wall thickness less than 0.040 inches, fuser roll diameter of up to 4" have been used with fuser roll lengths up to 48".

To fabricate a fuser roll or cylindrical member, it is necessary to first start with a filament wound cylinder or tube. The remaining portions of the system fabricated from the tube outward. The filament core structure can be wound on a mandrel using standard winding machines. The machine computer could be set or tailored to give proper winding angles (47° to 59°) to obtain the maximum mechanical strength. Each cylinder would be wound until a desired wall thickness is obtained, preferably 20 to 40 mils. At this point, fabrication would vary with the size of the roll, length, and production quantity. For short run large rolls, it is possible to consider winding a spiral heating element directly on the surface of the filament wound core. And additional layer of filament winding would be wound directly over the filament and the entire structure cured to suitable specifications. After curing, the composite structure would be ground to obtain a smooth outer surface for finishing.

Assuming standard xerographic fuser rolls are of 1" to 2" in diameter and approximately 16" long, high speed continuous filament winding can be considered. With this type of fabrication, the core or cylindrical member would be wound to a desired wall thickness and continuously fed down its mandrel to be cured, ground, and be cut to length. With this technique, a heater foil could be wrapped on the outside surface of the core and finished in the second operation.

In accordance with the present invention, the change to a comformable fusing system is structured around the capability of plastic composite manufacturing process technologies to alter or reduce the hoop stiffness in relation to the longitudinal stiffness. This is accomplished by changes in the angle of wrap during the filament winding process as well as by the number of fibers and the type of fiber utilized. Binder materials, type of reinforcing fibers, fiber orientation combined with their associated thermal, stiffness and fatigue properties are of utmost importance. The key to filament winding is that anisotropic behavior is customized through the placement of reinforcement only in areas required such as (building a radial tire).

Resin/binder materials include high temperature thermoplastics (polyamide-imide, liquid crystal polymers, polyphenylene sulfide, polysulfones, polyetherimides, etc.) and thermosets (epoxies) polysters, and polyimides). Reinforcing materials include glass fibers, Kevlar, graphite, and hybrids of each. Depending on the load requirements unreinforced materials could be used and conventional manufacturing processes such as extrusion could be adopted. Composite material properties such as fatigue, flexure, long-term aging characteristics are extremely important.

With reference to FIG. 3, in accordance with the present invention a flexible filament wound tube 60 is the core of the fuser roll generally shown at 62 with a foil heater 64 and a release coating bonded to its surface to complete the laminate. In a specific embodiment, the total thickness of the wall is between 0.010 and 0.030 inches as illustrated and the diameter of the core is $\geqq 1.20$ inches. The release coating is any suitable composition such as P.F.A. silicone rubber. In a preferred embodiment, a foil heater includes heater legs designed to provide the greatest length in the longitudinal roll direction to allow for thermal expansion without girdling the roll or inducing fatigue.

Figure 4A:
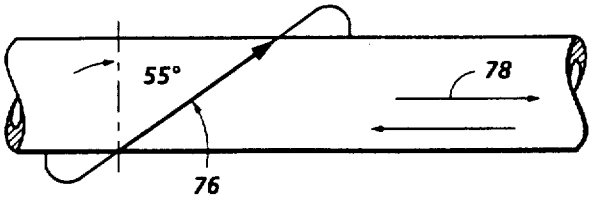
FIGS. 4A, 4B and 4C illustrates strand orientation of a filament wound cylinder

The flexible backup roll generally shown at 68 is will be constructed in the same manner with the option to omit the heater and possibly add additional release coating material thickness 70. As illustrated, the flexing rolls 62 and 68 conform to provide a nip 72 for paper 74 greater than 0.500 inches. FIG. 4A shows a typical method and that a filament wound tube might be fabricated, with some fibers wound at 55° in the hoop or strand 76 direction, with others parallel in the longitudinal direction 78. The end plugs outlined in FIGS. 5A and 5B must also be conformable, the conformable arm must be strong enough to drive the unit with sufficient flex to allow a suitable nip length, preferably the minimum 0.500 inch length. Electrical leads will be led from the foil heater out to the end caps where a brush, slip ring or other type of electrical pickup will feed back to a resistive type control unit. The electrical pickup hardware could be molded into the end caps.

Figure 4B:
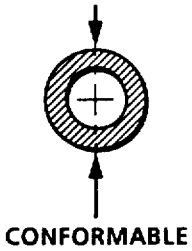
Figure 4C:
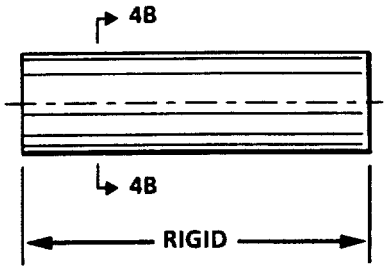

As illustrated in FIG. 3, the fuser roll 62 with attached heating element is disposed transverse the direction of movement of the copy sheet or paper 74 and is flexible in a radial direction toward the center of the cylinder. The heating element 64 is disposed about the circumference of the elongated cylinder. The back up roll is also disposed transverse the direction of movement of the copy sheet or paper 74 and is also flexible in a radial direction toward the center of the cylinder to define the nip 72 but rigid in the longitudinal direction as shown in FIGS. 4B and 4C as is the fuser roll 62.

Figure 5A:
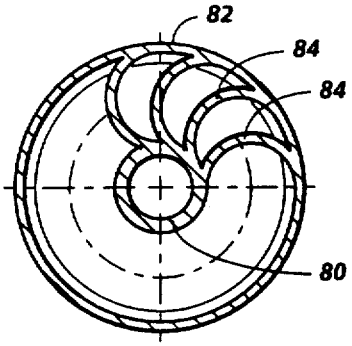
FIGS. 5A and 5B are an elevational view of an end cap support for the heating roll of FIG. 3 in accordance with another aspect of the present invention.
Figure 5B:
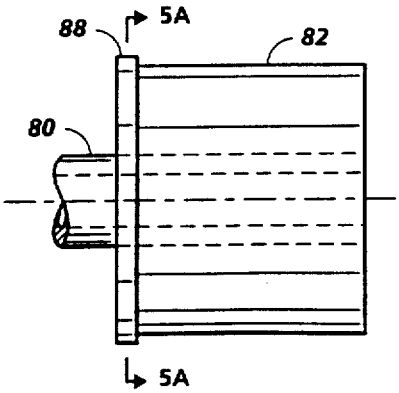

In accordance with the present invention, the flexing of the engaged cylinders or rolls provides the elongated, essentially flat nip. Generally, the fuser roll 62 and back up roll 68 must be supported. The support could be accomplished by a elongated cores or support elements or by a pair of end caps such as shown with reference to FIGS. 5A and 5B, illustrating one type of end cap or support contemplated within the scope of the invention. The end plugs outlined in FIGS. 5A and 5B must also be comformable, the comformable arm must be strong enough to drive the unit with sufficient flex to allow a suitable nip length, preferably the minimum 0.500 inch length. Electrical leads will be led from the foil heater out to the end caps where a brush, slip ring or other type of electrical pickup will feed back to a resistive type control unit. The electrical pickup hardward could be molded into the end caps. Each of the caps includes a rigid shaft 80 for engaging a frame or any suitable support mount, a sleeve 82 disposed about the shaft, and a plurality of flexible fingers 84 interconnecting the shaft and the sleeve. The flexible fingers 84 are strong enough to drive the roll, but flexible enough to flex with pressure to engage the opposite roll to form the nip. The end cap can be suitably cemented or locked in place to the elongated cylinder 88. Rather than a pair of end caps, a single core with flexible fingers could traverse the entire length of the elongated cylinder to provide the necessary support.

While there has been illustrated and described what is at present considered to be a preferred embodiment of the present invention, it will be appreciated that numerous changes and modifications are likely to occur to those skilled in the art, and it is intended in the appended claims to cover all those changes and modifications falling within the true spirit and scope of the present invention.

We claim:

1. In an electrostatic copying machine having fusing apparatus of the type including a heated fuser roll and a back-up roll defining a nip through which support material bearing toner images is moved in a given direction for fusing the toner images onto the support material, the fusing apparatus comprising:

a first elongated cylinder disposed transverse the direction of movement of the support material, the first elongated cylinder being flexible in a radial direction toward the center of the cylinder, a first core supporting the first elongated cylinder transverse the direction of movement of the support material, the first elongated cylinder being disposed about the circumference of the first core, the first core being flexible in a radial direction toward the center of the cylinder, a heating element disposed about the outside circumference of the first elongated cylinder, a second elongated cylinder disposed transverse the direction of movement of the support material, the second elongated cylinder being flexible in a radial direction toward the center of the cylinder, the first elongated cylinder and the second elongated cylinder defining the nip, and a second core supporting the second elongated cylinder transverse the direction of movement of the support material, the second elongated cylinder being disposed about the circumference of the second core, the second core being flexible in a radial direction toward the center of the cylinder, the flexing of the engaged cylinders providing an elongated, essentially flat nip.

2. The apparatus of claim 1 including a heating element disposed about the circumference of the second elongated cylinder.

3. The apparatus of claim 1 wherein the first core includes a rigid shaft, a sleeve disposed about the shaft, and a plurality of flexible fingers interconnecting the shaft and the sleeve.

4. In an electrostatic copying machine having fusing apparatus of the type defining a nip through which support material bearing toner images is moved in a given direction for fusing the toner images onto the support material, the fusing apparatus comprising:

a heater roll disposed transverse the direction of movement of the support material, the heater roll having a longitudinal direction and a hoop direction, being stiff in the longitudinal direction and conforming in the hoop direction, a core supporting the heater roll, the heater roll being disposed about the circumference of the core, the core including a rigid shaft, a sleeve disposed about the shaft, and a plurality of flexible fingers interconnecting the shaft and the sleeve, the fingers adapted for compression toward the shaft, and a back up roll disposed transverse the direction of movement of the support material, the back up roll being stiff in the longitudinal direction and conforming in the hoop direction, the engagement of the heater roll and the back up roll defining an elongated, essentially flat nip.

5. The apparatus of claim 4 wherein the core includes a pair of end caps supporting the heater roll, each of the caps including a rigid shaft, a sleeve disposed about the shaft, a plurality of flexible fingers interconnecting the shaft and the sleeve.

6. The apparatus of claim 4 wherein the rigid shaft extends the length of the heater roll.

7. An electrostatic copying machine having fusing apparatus of the type defining a nip through which support material bearing toner images is passed for fusing the toner images onto the support material, the fusing apparatus comprising:

a fuser roll including a hollow cylinder having a relatively thin wall, the cylinder being a plastic composition reinforced with a filler, the cylinder having an outside and an inside surface, and a back up roll including a hollow cylinder having a relatively thin wall, the cylinder being a plastic composition reinforced with a filler, the cylinder having an outside and an inside surface, the outside surface of the fuser roll being disposed in an engaging relationship with the outside surface of the back up roll defining said nip, both the fuser roll and the back up roll flexing substantially equally to provide said nip.

8. The apparatus of claim 7 wherein each of the fuser and support rolls include a support core.

9. The appartus; paratus of claim 8 wherein the support cores include a pair of end caps, each of the caps including a rigid shaft, a sleeve disposed about the shaft, and a plurality of flexible fingers interconnecting the shaft and the sleeve, the fingers adapted for compression toward the shaft.

10. The apparatus of claim 8 where the support cores include a rigid shaft traversing the length of the rolls, a sleeve disposed about the shaft, and a plurality of flexible fingers interconnecting the shaft and the sleeve, the fingers adapted for compression toward the shaft.

11. A fusing apparatus of the type defining a nip through which support material bearing toner images is passed for fusing the toner images onto the support material, the fusing apparatus comprising:

a fuser roll including a cylinder having a relatively thin wall, the cylinder being a plastic composition, the cylinder having an outside and an inside surface the cylinder being hollow, and being reinforced with a filler, and a back up roll including a cylinder having a relatively thin wall, the cylinder being a plastic composition, the cylinder having an outside and an inside surface, the outside surface of the fuser roll being disposed in an engaging relationship with the outside surface of the back up roll defining said nip, both the fuser roll and the back up roll flexing equally to provide said nip.

12. The fusing apparatus of claim 11 wherein the cylinder is reinforced with fibers.

* * * * *

UNITED STATES PATENT AND TRADEMARK OFFICE

CERTIFICATE OF CORRECTION

PATENT NO. : 5,012,072

DATED : April 30, 1991

INVENTOR(S) : Robert G. Martin, et al.

It is certified that error appears in the above-identified patent and that said Letters Patent is hereby corrected as shown below:

The Title page should be deleted to appear as per attached Title page.

The sheets of drawings consisting of Figs. 1-5. should be added as shown on the attached pages.

Signed and Sealed this

Eighth Day of December, 1992

*Attest:*

DOUGLAS B. COMER

*Attesting Officer*

*Acting Commissioner of Patents and Trademarks*

United States Patent [19]

Martin et al.

[11] Patent Number: 5,012,072

[45] Date of Patent: Apr. 30, 1991

[54] CONFORMABLE FUSING SYSTEM

[75] Inventors: Robert G. Martin, Irondequoit; Alan M. Litman, Webster, both of N.Y.

[73] Assignee: Xerox Corporation, Stamford, Conn.

[21] Appl. No.: 522,934

[22] Filed: May 14, 1990

[51] Int. Cl.[5] ..... G03G 15/20

[52] U.S. Cl. ..... 219/469; 219/216; 355/290

[58] Field of Search ..... 219/269, 270, 271, 216; 355/290; 432/60, 228

[56] References Cited

U.S. PATENT DOCUMENTS

| | | | |
|---|---|---|---|
| 3,449,548 | 6/1969 | Adamek | 219/216 |
| 3,666,247 | 5/1972 | Banks | 432/60 |
| 4,001,544 | 4/1977 | Heinzer | 219/216 |
| 4,219,327 | 8/1980 | Idstein | 432/60 |
| 4,290,691 | 9/1981 | Giorgini | 355/3 |
| 4,420,680 | 12/1983 | Itoh | 219/216 |
| 4,501,482 | 2/1985 | Stryjewski | 355/3 |
| 4,567,349 | 1/1986 | Henry et al. | 219/216 |
| 4,627,813 | 12/1986 | Sasaki | 432/60 |
| 4,814,819 | 3/1989 | Torino | 219/469 |
| 4,883,941 | 11/1989 | Martin et al. | 219/216 |

FOREIGN PATENT DOCUMENTS 59-172668 9/1984 Japan .

*Primary Examiner*—Teresa J. Walberg
*Attorney, Agent, or Firm*—Ronald F. Chapuran

[57] ABSTRACT

A fusing apparatus including a heater roll disposed transverse the direction of movement of the support material, the heater roll being stiff in the longitudinal direction and conforming in the hoop direction, a core supporting the heater roll, the heater roll being disposed about the circumference of the core, the core being conforming in the hoop direction, and a back up role disposed transverse the direction of movement of the support material, the back up role being stiff in the longitudinal direction and conforming in the hoop direction, the engagement of the heater role and the back up role defining an elongated, essentially flat nip.

12 Claims, 3 Drawing Sheets